US006229413B1

(12) United States Patent
Castonguay et al.

(10) Patent No.: US 6,229,413 B1
(45) Date of Patent: May 8, 2001

(54) SUPPORT OF STATIONARY CONDUCTORS FOR A CIRCUIT BREAKER

(75) Inventors: Roger Castonguay, Terryville; Dave S. Christensen, Burlington; Randy Greenberg, Granby, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/420,533

(22) Filed: Oct. 19, 1999

(51) Int. Cl.[7] ..... H01H 75/00; H01H 77/00; H01H 83/00

(52) U.S. Cl. ..... 335/16; 335/8; 335/147; 218/30

(58) Field of Search ..... 335/6, 8, 10, 16, 335/147, 195, 202; 218/22, 23, 24, 30, 31, 32, 33

(56) References Cited

U.S. PATENT DOCUMENTS

| | | |
|---|---|---|
| D. 367,265 | 2/1996 | Yamagata et al. . |
| 2,340,682 | 2/1944 | Powell . |
| 2,719,203 | 9/1955 | Gelzheiser et al. . |
| 2,937,254 | 5/1960 | Ericson . |
| 3,158,717 | 11/1964 | Jencks et al. . |
| 3,162,739 | 12/1964 | Klein et al. . |
| 3,197,582 | 7/1965 | Norden . |
| 3,307,002 | 2/1967 | Cooper . |
| 3,517,356 | 6/1970 | Hanafusa . |
| 3,631,369 | 12/1971 | Menocal . |
| 3,803,455 | 4/1974 | Willard . |
| 3,883,781 | 5/1975 | Cotton . |
| 4,129,762 | 12/1978 | Bruchet . |
| 4,144,513 | 3/1979 | Shafer et al. . |
| 4,158,119 | 6/1979 | Krakik . |
| 4,165,453 | 8/1979 | Hennemann . |
| 4,166,988 | 9/1979 | Ciarcia et al. . |
| 4,220,934 | 9/1980 | Wafer et al. . |
| 4,255,732 | 3/1981 | Wafer et al. . |
| 4,259,651 | 3/1981 | Yamt . |

(List continued on next page.)

FOREIGN PATENT DOCUMENTS

| | | |
|---|---|---|
| 819 008 | 12/1974 | (BE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 244 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |

(List continued on next page.)

*Primary Examiner*—Lincoln Donovan
*Assistant Examiner*—Tuyen T. Nguyen
(74) *Attorney, Agent, or Firm*—Cantor Colburn LLP; Carl B. Horton

(57) ABSTRACT

A circuit breaker having at least one cassette for receiving a conductive path. The conductive path is partially looped upon itself so that a first portion and a second portion of the conductive path are in a facially spaced relationship and the portions partially define an area for receiving a ferromagnetic material. The ferromagnetic material is insulated from the first portion and a support structure provides support for the first portion at two positions and the area is positioned in between these positions.

19 Claims, 5 Drawing Sheets

U.S. PATENT DOCUMENTS

| | | | | |
|---|---|---|---|---|
| 4,263,492 | | 4/1981 | Maier et al. . | |
| 4,276,527 | | 6/1981 | Gerbert-Gaillard et al. . | |
| 4,297,663 | | 10/1981 | Seymour et al. . | |
| 4,301,342 | | 11/1981 | Castonguay et al. . | |
| 4,360,852 | | 11/1982 | Gilmore . | |
| 4,368,444 | | 1/1983 | Preuss et al. . | |
| 4,375,021 | | 2/1983 | Pardini et al. . | |
| 4,375,022 | | 2/1983 | Daussin et al. . | |
| 4,376,270 | | 3/1983 | Staffen . | |
| 4,383,146 | | 5/1983 | Bur . | |
| 4,392,036 | | 7/1983 | Troebel et al. . | |
| 4,393,283 | | 7/1983 | Masuda . | |
| 4,401,872 | | 8/1983 | Boichot-Castagne et al. . | |
| 4,409,573 | | 10/1983 | DiMarco et al. . | |
| 4,435,690 | | 3/1984 | Link et al. . | |
| 4,467,297 | | 8/1984 | Boichot-Castagne et al. . | |
| 4,468,645 | | 8/1984 | Gerbert-Gaillard et al. . | |
| 4,470,027 | * | 9/1984 | Link et al. | 335/16 |
| 4,479,143 | | 10/1984 | Watanabe et al. . | |
| 4,488,133 | | 12/1984 | McClellan et al. . | |
| 4,492,941 | | 1/1985 | Nagel . | |
| 4,541,032 | | 9/1985 | Schwab . | |
| 4,546,224 | | 10/1985 | Mostosi . | |
| 4,550,360 | | 10/1985 | Dougherty . | |
| 4,562,419 | | 12/1985 | Preuss et al. . | |
| 4,589,052 | | 5/1986 | Dougherty . | |
| 4,595,812 | | 6/1986 | Tamaru et al. . | |
| 4,611,187 | | 9/1986 | Banfi . | |
| 4,612,430 | | 9/1986 | Sloan et al. . | |
| 4,616,198 | | 10/1986 | Pardini . | |
| 4,622,444 | | 11/1986 | Kandatsu et al. . | |
| 4,631,625 | | 12/1986 | Alexander et al. . | |
| 4,642,431 | | 2/1987 | Tedesco et al. . | |
| 4,644,438 | | 2/1987 | Puccinelli et al. . | |
| 4,649,247 | | 3/1987 | Preuss et al. . | |
| 4,654,490 | * | 3/1987 | Leone et al. | 335/16 |
| 4,658,322 | | 4/1987 | Rivera . | |
| 4,672,501 | | 6/1987 | Bilac et al. . | |
| 4,675,481 | | 6/1987 | Markowski et al. . | |
| 4,682,264 | | 7/1987 | Demeyer . | |
| 4,689,712 | | 8/1987 | Demeyer . | |
| 4,694,373 | | 9/1987 | Demeyer . | |
| 4,710,845 | | 12/1987 | Demeyer . | |
| 4,717,985 | | 1/1988 | Demeyer . | |
| 4,733,211 | | 3/1988 | Castonguay et al. . | |
| 4,733,321 | | 3/1988 | Lindeperg . | |
| 4,764,650 | | 8/1988 | Bur et al. . | |
| 4,768,007 | | 8/1988 | Mertz et al. . | |
| 4,780,786 | | 10/1988 | Weynachter et al. . | |
| 4,831,221 | | 5/1989 | Yu et al. . | |
| 4,870,531 | | 9/1989 | Danek . | |
| 4,883,931 | | 11/1989 | Batteux et al. . | |
| 4,884,047 | | 11/1989 | Baginski et al. . | |
| 4,884,164 | | 11/1989 | Dziura et al. . | |
| 4,900,882 | | 2/1990 | Bernard et al. . | |
| 4,910,485 | | 3/1990 | Bolongeat-Mobleu et al. . | |
| 4,914,541 | | 4/1990 | Tripodi et al. . | |
| 4,916,420 | | 4/1990 | Bartolo et al. . | |
| 4,916,421 | | 4/1990 | Pardini et al. . | |
| 4,926,282 | | 5/1990 | McGhie . | |
| 4,935,590 | | 6/1990 | Malkin et al. . | |
| 4,937,706 | | 6/1990 | Schueller et al. . | |
| 4,939,492 | | 7/1990 | Raso et al. | 335/42 |
| 4,943,691 | | 7/1990 | Mertz et al. . | |
| 4,943,888 | | 7/1990 | Jacob et al. . | |
| 4,950,855 | | 8/1990 | Bolonegeat-Mobleu et al. . | |
| 4,951,019 | | 8/1990 | Gula . | |
| 4,952,897 | | 8/1990 | Barnel et al. . | |
| 4,958,135 | | 9/1990 | Baginski et al. . | |
| 4,965,543 | | 10/1990 | Batteux . | |
| 4,983,788 | | 1/1991 | Pardini . | |
| 5,001,313 | | 3/1991 | Leclerq et al. . | |
| 5,004,878 | | 4/1991 | Seymour et al. . | |
| 5,029,301 | * | 7/1991 | Nebon et al. | 335/16 |
| 5,030,804 | | 7/1991 | Abri . | |
| 5,057,655 | | 10/1991 | Kersusan et al. . | |
| 5,077,627 | | 12/1991 | Fraisse . | |
| 5,083,081 | | 1/1992 | Barrault et al. . | |
| 5,095,183 | | 3/1992 | Raphard et al. . | |
| 5,103,198 | | 4/1992 | Morel et al. . | |
| 5,115,371 | | 5/1992 | Tripodi . | |
| 5,120,921 | | 6/1992 | DiMarco et al. . | |
| 5,132,865 | | 7/1992 | Mentz et al. . | |
| 5,138,121 | | 8/1992 | Streich et al. . | |
| 5,140,115 | | 8/1992 | Morris . | |
| 5,153,802 | | 10/1992 | Mertz et al. . | |
| 5,155,315 | | 10/1992 | Malkin et al. . | |
| 5,166,483 | | 11/1992 | Kersusan et al. . | |
| 5,172,087 | | 12/1992 | Castonguay et al. . | |
| 5,178,504 | | 1/1993 | Falchi . | |
| 5,184,717 | | 2/1993 | Chou et al. . | |
| 5,187,339 | | 2/1993 | Lissandrin . | |
| 5,198,956 | | 3/1993 | Dvorak . | |
| 5,200,724 | | 4/1993 | Gula et al. . | |
| 5,210,385 | | 5/1993 | Morel et al. . | |
| 5,239,150 | | 8/1993 | Bolongeat-Mobleu et al. . | |
| 5,260,533 | | 11/1993 | Livesey et al. . | |
| 5,262,744 | | 11/1993 | Arnold et al. . | |
| 5,280,144 | | 1/1994 | Bolongeat-Mobleu et al. . | |
| 5,281,776 | | 1/1994 | Morel et al. . | |
| 5,296,600 | | 3/1994 | Morel et al. . | |
| 5,296,664 | | 3/1994 | Crookston et al. . | |
| 5,298,874 | | 3/1994 | Morel et al. . | |
| 5,300,907 | | 4/1994 | Nereau et al. . | |
| 5,310,971 | | 5/1994 | Vial et al. . | |
| 5,313,180 | | 5/1994 | Vial et al. . | |
| 5,317,471 | | 5/1994 | Izoard et al. . | |
| 5,331,500 | | 7/1994 | Corcoles et al. . | |
| 5,334,808 | | 8/1994 | Bur et al. . | |
| 5,341,191 | | 8/1994 | Crookston et al. . | |
| 5,347,096 | | 9/1994 | Bolongeat-Mobleu et al. . | |
| 5,347,097 | | 9/1994 | Bologneat-Mobleu et al. . | |
| 5,350,892 | | 9/1994 | Rozier . | |
| 5,357,066 | | 10/1994 | Morel et al. . | |
| 5,357,068 | | 10/1994 | Rozier . | |
| 5,357,394 | | 10/1994 | Piney . | |
| 5,361,052 | | 11/1994 | Ferullo et al. . | |
| 5,373,130 | | 12/1994 | Barrault et al. . | |
| 5,379,013 | | 1/1995 | Coudert . | |
| 5,424,701 | | 6/1995 | Castonguary et al. . | |
| 5,438,176 | | 8/1995 | Bonnardel et al. . | |
| 5,440,088 | | 8/1995 | Coudert et al. . | |
| 5,449,871 | | 9/1995 | Batteux et al. . | |
| 5,450,048 | | 9/1995 | Leger et al. . | |
| 5,451,729 | | 9/1995 | Onderka et al. . | |
| 5,457,295 | | 10/1995 | Tanibe et al. . | |
| 5,467,069 | | 11/1995 | Payet-Burin et al. . | |
| 5,469,121 | | 11/1995 | Payet-Burin . | |
| 5,475,558 | | 12/1995 | Barjonnet et al. . | |
| 5,477,016 | | 12/1995 | Baginski et al. . | |
| 5,479,143 | | 12/1995 | Payet-Burin . | |
| 5,483,212 | | 1/1996 | Lankuttis et al. . | |
| 5,485,343 | | 1/1996 | Santos et al. . | |
| 5,493,083 | | 2/1996 | Olivier . | |
| 5,504,284 | | 4/1996 | Lazareth et al. . | |
| 5,504,290 | | 4/1996 | Baginski et al. . | |
| 5,510,761 | | 4/1996 | Boder et al. . | |
| 5,512,720 | | 4/1996 | Coudert et al. . | |
| 5,515,018 | | 5/1996 | DiMarco et al. . | |
| 5,519,561 | | 5/1996 | Mrenna et al. . | |
| 5,534,674 | | 7/1996 | Steffens . | |

| | | | | |
|---|---|---|---|---|
| 5,534,832 | | 7/1996 | Duchemin et al. . | |
| 5,534,835 | | 7/1996 | McColloch et al. . | |
| 5,534,840 | | 7/1996 | Cuingnet . | |
| 5,539,168 | | 7/1996 | Linzenich . | |
| 5,543,595 | | 8/1996 | Mader et al. . | |
| 5,552,755 | | 9/1996 | Fello et al. . | |
| 5,581,219 | | 12/1996 | Nozawa et al. . | |
| 5,604,656 | | 2/1997 | Derrick et al. . | |
| 5,608,367 | | 3/1997 | Zoller et al. . | |
| 5,694,098 | * | 12/1997 | Mody et al. | 335/16 |
| 5,784,233 | | 7/1998 | Bastard et al. . | |

FOREIGN PATENT DOCUMENTS

| | | |
|---|---|---|
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 313 106 | 4/1989 | (EP) . |
| 0 313 422 | 4/1989 | (EP) . |
| 3 309 923 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 922 | 10/1990 | (EP) . |
| 0 3940 144 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 | 9/1993 | (EP) . |
| 0 567 416 | 10/1993 | (EP) . |
| 0 595730 | 5/1994 | (EP) . |
| 0 619 591 | 10/1994 | (EP) . |
| 0 665 569 | 8/1995 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

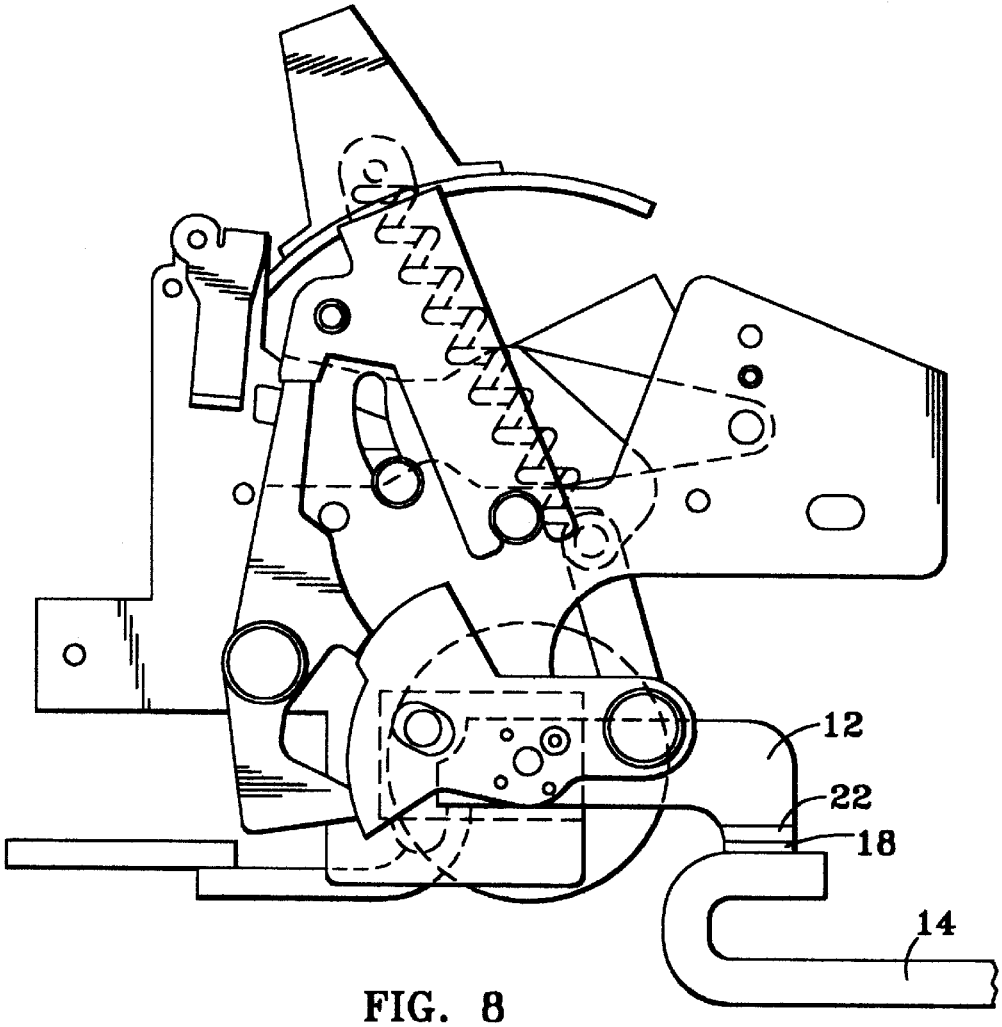
FIG. 8
FIG. 9
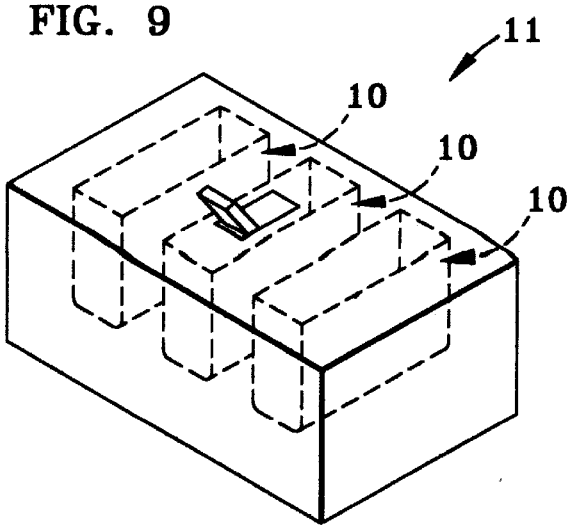

SUPPORT OF STATIONARY CONDUCTORS FOR A CIRCUIT BREAKER

FIELD OF THE INVENTION

This invention relates to circuit breakers and, more particularly, a means for supporting the stationary conductor and surrounding area of the "reverse loop", a portion of the circuit breaker wherein a line or load strap it is partially looped around itself to provide a repelling electromagnetic force which will ultimately cause the circuit breaker to trip if the force exceeds the tolerances of the breaker.

This invention also relates to a support that provides a means for insulating the "reverse loop".

BACKGROUND OF THE INVENTION

During repeat operation of a circuit breaker, as well as during manufacture, the copper used in the conductor path is repeatedly heated and cooled. This heating and cooling causes the copper to become annealed. The annealing of the copper will cause it to lose some of its strength and thereby affecting the performance of the circuit breaker.

In addition, the area surrounding the stationary contact, there is repeatedly loaded from the repeated on-off operation of the circuit breaker. This repeated loading causes bending and/or deformation to the contact surface. Such deformations to the contact surface may cause an inadequate contact that may affect the circuit breaker performance.

In particular, the stationary conductors often suffer the greatest degradation. Since there is often a limited amount of space in the circuit breaker design, thicker materials are generally not used. Moreover, thicker and stronger materials cost more and add to the overall cost of manufacture.

Providing support to an un-insulated portion of the conductor path of the reverse loop will cause the same to short out and, accordingly, the circuit breaker will operate improperly.

In addition, a magnetic flux concentrator, for enhancing the electromagnetic force of the reverse loop, usually in the form of a steel block, is positioned within the reverse loop. The placement of the magnetic flux concentrator requires the implementation of at least one insulating buffer zone positioned between the magnetic flux concentrator and a portion of the reverse loop. This buffer zone prevents the short circuit of the reverse loop.

U.S. Pat. No. 5,313,180 entitled Molded Case Circuit Breaker Contact, describes a rotary circuit breaker. The above patent also describes the use of an anvil formed from a rigid metal block. The anvil is positioned in between the two strands of a current input conductor or "reverse loop" and makes contact with one of the strands to receive impact forces from the movable contact as it strikes the stationary contact positioned on the strand making contact with the anvil. In addition, the anvil in this patent also serves as a magnetic flux concentrator.

SUMMARY OF THE INVENTION

In an exemplary embodiment of the present invention, the circuit breaker provides support to a line and/or load strap and related stationary contact.

Another embodiment of the present invention provides support to a line and/or load strap while also insulating the same from the magnetic flux concentrator.

BRIEF DESCRIPTION OF THE DRAWINGS

FIG. 8 is an illustration of a circuit breaker having a single contact; and

FIG. 9 is a perspective view of a circuit breaker.

DESCRIPTION OF THE PREFERRED EMBODIMENTS

Figure 1:
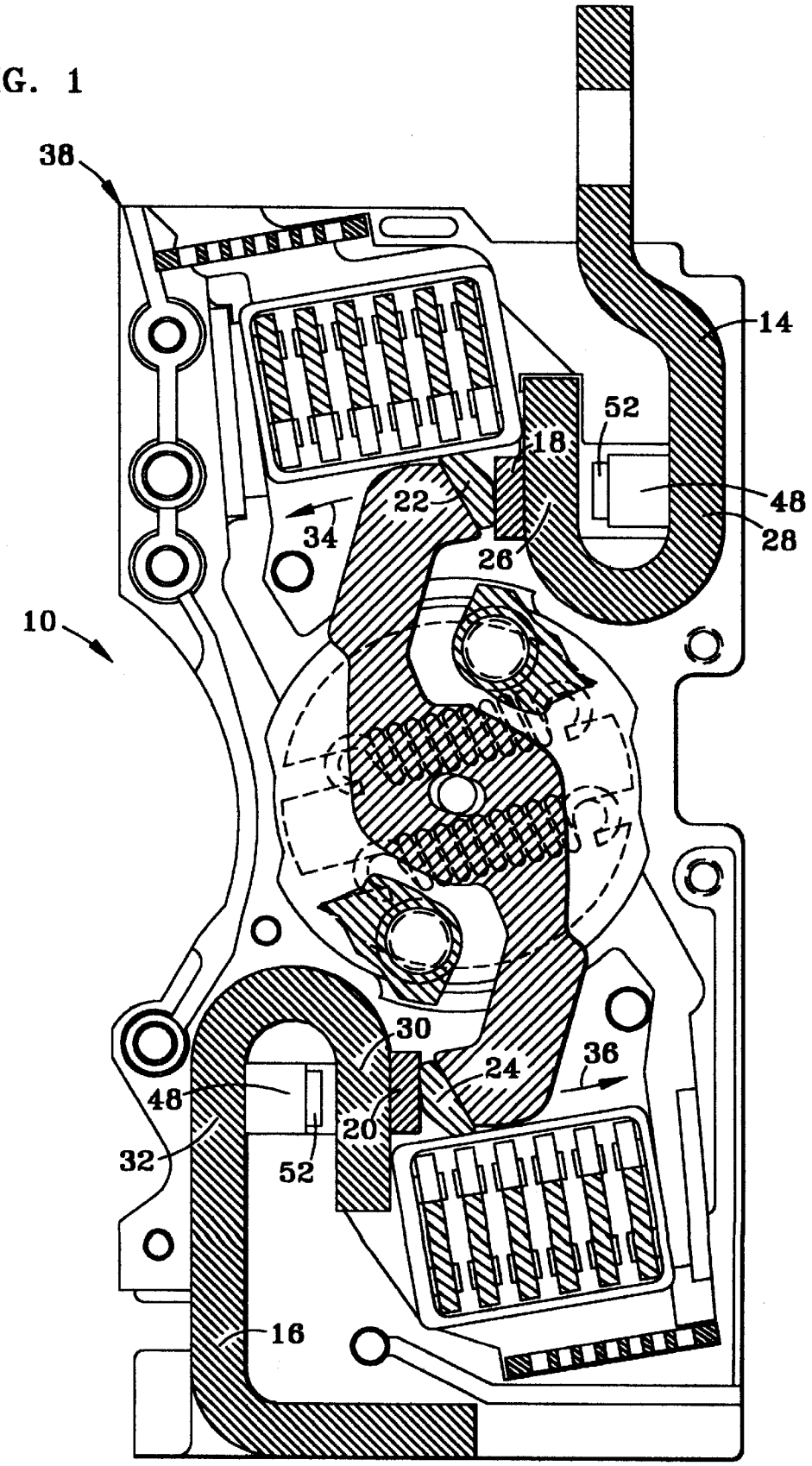
FIG. 1 is a view along lines 1—1 of FIG. 4 illustrating a view of a circuit breaker assembly of the type employing a rotary contact operating mechanism having the conductor support and insulation of the present invention.

FIG. 1, generally illustrates a circuit breaker interrupter 10 for use in a circuit breaker 11. (FIG. 9). Circuit breaker interrupter 10 has a movable contact assembly 12.

A line strap 14 and a load strap 16, a pair of stationary contacts 18 and 20, a pair of movable contacts 22 and 24 and movable contact assembly 12, generally complete the circuit from an electrical supply line to a given load.

Figure 2:
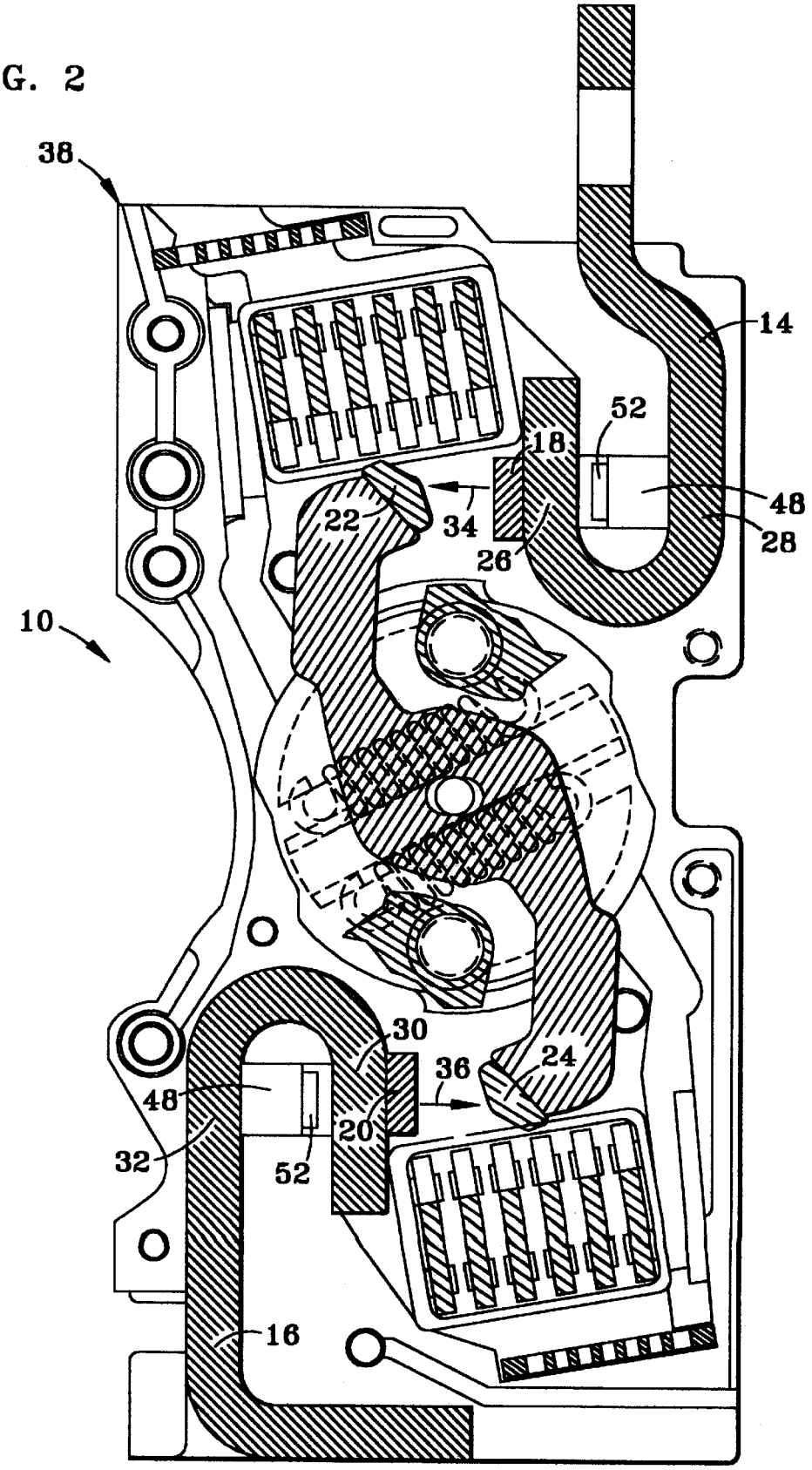
FIG. 2 is a view illustrating a possible position of the circuit breaker assembly illustrated in FIG. 1.

FIG. 1 illustrates circuit breaker interrupter 10 in a closed position while FIG. 2 illustrates circuit breaker interrupter 10 an open or tripped position.

Line strap 14 and load strap 16 are configured to have a partial or uncompleted loop at their ends. This results in straps 14 and 16 being folded or doubled back over themselves. Accordingly, a first portion 26 is in a facing spaced relationship with respect to a second portion 28 of line strap 14.

Similarly, and as contemplated with a circuit breaker have both a line and load strap configuration a first portion 30 is also in a facing spaced relationship with respect to a second portion 32 of load strap 16.

Straps 14 and 16 provide a conductive path and are adapted for connection with an associated electrical distribution system and a protected electric circuit. Alternatively, and as desired, straps 14 and 16 can be either a line or a load strap.

Stationary contacts 18 and 20 are connected to receive an electrical current from straps 14 and 16. Accordingly, and as illustrated in FIG. 1 when movable contact assembly 12 is in its closed position, movable contacts 22 and 24 make contact with stationary contacts 18 and 20 thereby completing the circuit from line strap 14 to load strap 16.

As an electrical current flows through straps 14 and 16 it is noted that the portion of straps 14 and 16, in close proximity to stationary contacts 18 and 20, will have currents of opposite polarities with respect to the electrical current flowing through movable contact assembly 12.

This configuration generates a magnetic field having a force in the direction of arrows 34 and 36. Movable contact assembly 12 is maintained in its closed position by a mechanical force in the opposite direction of arrows 34 and 36. Once the force in the direction of arrows 34 and 36 overcomes the mechanical force maintaining movable contact assembly 12 in its closed position, the circuit breaker pops (low current levels) or blows open (higher current levels) movable contacts 22 and 24 no longer make contact with stationary contacts 18 and 20.

Figure 3:
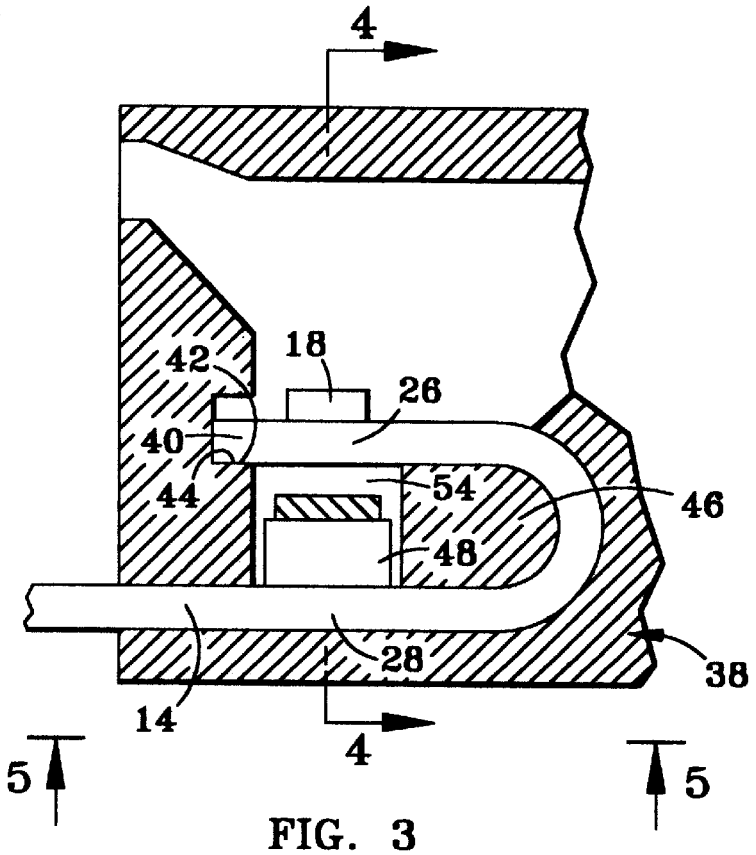
FIG. 3 is a cross-sectional view of illustrating the conductor support and component parts of the present invention.
Figure 4:
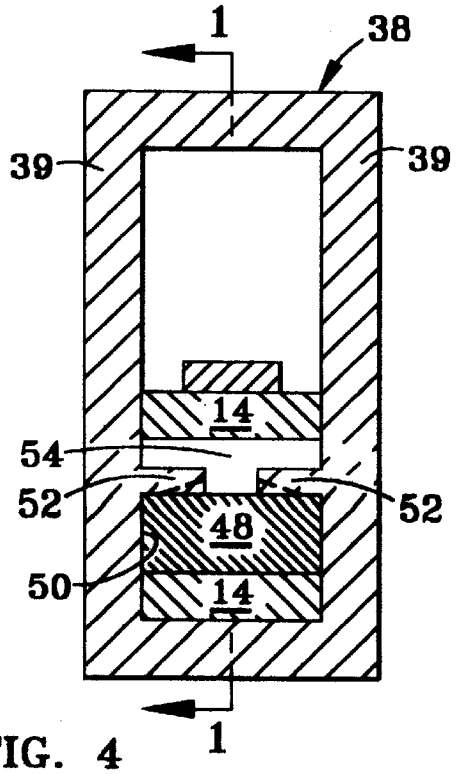
FIG. 4 is a view along lines 4—4 of the FIG. 3 embodiment.
Figure 5:
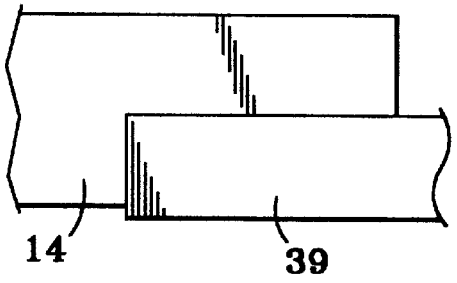
FIG. 5 is a view along lines 5—5 of the FIG. 3 embodiment.

Referring now to FIGS. 3 and 4, and in accordance with the present invention, strap 14 is received within a cassette body portion 38 of circuit breaker interrupter 10. Cassette body portion 38 is constructed out of a pair of cassette body portions 39. Cassette body portions 39 are constructed out a molded plastic having insulating properties, as well as being durable and lightweight.

Cassette body portions 39 are secured to each other through a securement means including, but not limited to, the following, rivets, screws, nut and bolt arrangement, adhesives or any other method of securement.

As illustrated in FIG. 3, line strap 14 partially loops back over itself and terminates in an end 40.

Each cassette body portion 39 is configured to have a receiving area 42 configured to receive and support the end portion 40 of line strap 14.

Similarly, each cassette body portion has a shoulder 44 that provides support to end 40. Additional support is provided to line strap 14 through a support surface 46 positioned on each cassette body portion. Support surfaces 46 are configured to support a portion of line strap 14. The positioning of shoulders 44 and support surfaces 46 provide support to portion 26, and accordingly, stationary contact 18 of line strap 14.

This additional support of line strap 14 prevents portion 26 of line strap 14 and accordingly stationery contact 18 from being deformed or displaced through repeated operation of the circuit breaker. For example, as circuit breaker interrupter 10 is opened and closed or tripped, reset and closed, movable contacts 22 and 24 repeatedly apply a contact force to stationary contacts 18 and 20. In addition, and during normal operational parameters, a substantial mechanical force is applied to movable contact assembly 12 in order to maintain the connection between movable contacts 22 and 24 and stationary contacts 18 and 20. Therefore, portions 26 and 30 as well as stationary contacts 18 and 20 require support in order to prevent movement or displacement of the same.

Also, the repeated contact of movable contacts 22 and 24 into stationary contacts 18 and 20 causes an additional force to be acted upon the surrounding portions 26 and 30 of line strap 14 and load strap 16 respectively.

Moreover, and as the circuit breaker is repeatedly tripped, the line and load straps (14, 16) as well as their complementary stationery contacts (18, 20) may become heated and subsequently cooled. This heating and cooling may cause the copper and/or other conductive materials used for the straps and contacts to become annealed.

In addition, stationary contacts 18 and 20 are usually brazed to the respective portion of line strap 14 and load strap 16. This process also may attribute to the annealing of the copper in line strap 14, load strap 16 and stationary contacts 18 and 20.

A magnetic flux concentrator 48 is positioned within an opening 50 of cassette body portions 39. Magnetic flux concentrator 48 is constructed out of a ferromagnetic magnetic material such as steel. Cassette body portion 38 is also configured to have a pair of tabs or sidewalls 52 which extend inwardly towards each other from cassette body portions 39. The positioning of tabs 52 also defines a portion of opening 50.

Tabs 52 are positioned in a facially spaced relationship so as to define a means for retaining magnetic flux concentrator 48 in a fixed position. Moreover, tabs 52 are also constructed out of a molded plastic that gives them insulating properties.

Tabs 52 retain magnetic flux concentrator 48 within opening 50. The configuration of opening 50 and cassette body portions 39 causes magnetic flux concentrator 48 to be in contact with a portion of line strap 14.

In addition, the positioning of tabs 52 also defines an air gap 54. Air gap 54 is positioned in between magnetic flux concentrator 48 and portion 26 of line strap 14. Since magnetic flux concentrator 48 is in contact with portion 28 of line strap 14, air gap 54 insulates magnetic flux concentrator 48 from short-circuiting the reverse loop defined by line strap 14.

As an alternative, and as illustrated by the dashed lines in FIG. 4, and in order to facilitate the insertion of magnetic flux concentrator 48 into opening 50 of cassette body portion 38, tabs 52 are chamnfered along the surface making content with MFC 48.

Referring now in particular to FIG. 4, it is noted that air gap 54 extends from line strap 14 to magnetic flux concentrator 48, as tabs 52 do not extending completely towards each other.

Alternatively, air gap 54 is completely or partially replaced with a polymeric or other material that has insulating properties.

It is, of course, understood and contemplated that the present invention can be used with a circuit breaker having both a line and load strap or a single contact circuit breaker.

In addition, one such contemplated use of the present invention is with a circuit breaker having a single reverse loop. One such circuit breaker is illustrated in FIG. 8.

Figure 6:
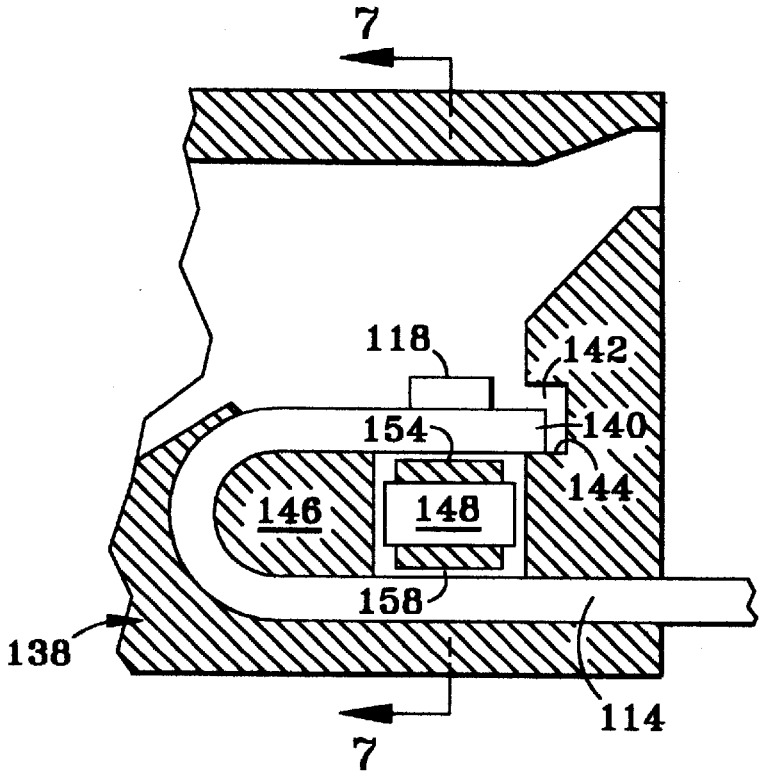
FIG. 6 is a cross-sectional view of an alternative embodiment of the present invention.
Figure 7:
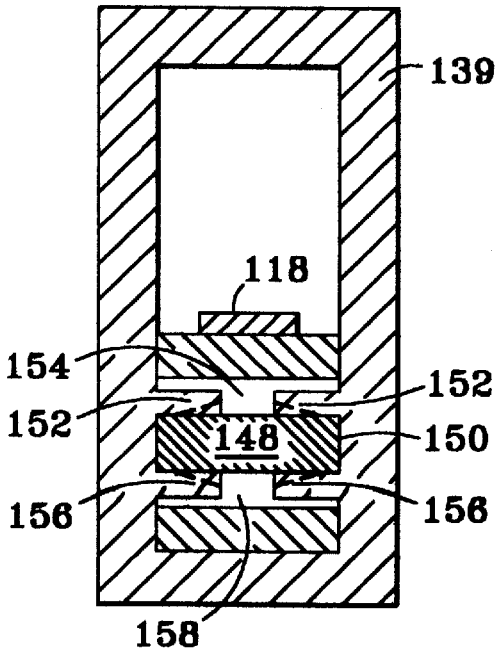
FIG. 7 is a view along lines 6—6 of the FIG. 6 embodiment.

Referring now to FIGS. 6 and 7, an alternative embodiment of the present invention is illustrated. Here component parts performing similar or analogous functions are labeled in multiples of 100.

Here a line strap 114 is configured to have a partial loop terminating in an end 140. A cassette body portion 138 is configured to have a receiving area 142 into which end 140 is received and supported. In particular, a shoulder portion 144 supports end 140.

Additionally, a support surface 146 is configured to support a portion of line strap 114. In this embodiment cassette body portion 138 is configured to have a first pair of tabs 152 and a second pair of tabs 156.

Tabs 152 are in a facial spaced relationship with respect to each other so as to define an air gap 154 between each other and line strap 114. Tabs 156 are also in a facial spaced relationship with respect to each other so as to define an air gap 158 between each other and line strap 114.

Tabs 152 and 156 are also in a facial spaced relationship with respect to each other and define an opening 150 into which a magnetic flux concentrator 148 is received and supported. The positioning of tabs 152 and 156 causes magnetic flux concentrator 148 to be supported in a position wherein magnetic flux concentrator 148 makes no contact with line strap 1 14. Moreover, tabs 152 and 156 support magnetic flux concentrator 148 within the area defined by portions 126 and 128 of line strap 114.

Accordingly, air gaps 154 and 158 insulate magnetic flux concentrator 148 from the reverse loop of line strap 114. This will prevent magnetic flux concentrator 148 from short-circuiting the reverse loop.

Moreover, and in high current conditions, there is a possibility of a "flashover", a condition in which the current bridges the air gap between magnetic flux concentrator 148 and a portion of line strap 114. In this embodiment, the positioning and inclusion of two air gaps 154 and 158 will make it harder for magnetic flux concentrator 148 to short-circuit the "reverse loop" via a "flashover" condition as both air gaps 154 and 158 will have to be bridged.

As an alternative, and as illustrated by the dashed lines in FIG. 7, and in order to facilitate the insertion of magnetic flux concentrator 148 into opening 150 of cassette body portion 138, tabs 152 and 156 are chamfered.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A support for a conductive path in a circuit interruption mechanism, said support comprising:

a) a first support surface;

b) a second support surface, said first support surface and said second support surface providing support to a first portion of said conductive path, said first portion of said conductive path being in a facially spaced relationship with respect to a second portion of said conductive path;

c) an area being defined by said first and second portions of said conductive path and said first and second support surfaces;

d) a ferromagnetic material being supported by a cassette of said circuit interruption mechanism, said ferromagnetic material being positioned within said area, said ferromagnetic material being insulated from said first portion of said conductive path;

e) an air gap being positioned in between said ferromagnetic material and said first portion of said conductive path; and f) a first pair of tabs extending into said area, said tabs being configured, dimensioned and positioned to maintain said ferromagnetic material within said area.

2. A support as in claim 1, wherein said first pair of tabs are chamfered.

3. A support as in claim 1, wherein said circuit interruption mechanism further comprises:

g) a second pair of tabs extending into said area, said tabs being configured, dimensioned and positioned to maintain said ferromagnetic material within said area and said area and said ferromagnetic material are insulated from said first and second portions of said conductive path.

4. A circuit breaker comprising:

a) at least one cassette, said cassette receiving a conductive path, a portion of said conductive path being partially looped upon itself and having a first loop portion and a second loop portion, said first and second loop portions each have an inner surface and an outer surface, said inner surfaces of said first and second loop portions are in a facially spaced relationship so as to define an area;

b) a ferromagnetic material being supported by said cassette and positioned within said area;

c) a first support surface for supporting said inner surface of said first loop portion;

d) a second support surface for supporting said inner surface ofsaid first loop portion of said conductive path, said first and second support surfaces beingin a facially spaced relationship and further define said area;

e) an air gap being positioned in between said ferromagnetic material and said first loop portion of said conductive path; and f) a first pair of tabs extending into said area, said tabs being configured, dimensioned and positioned to maintain said ferromagnetic material within said area.

5. A circuit breaker as in claim 4, further including:

g) a stationary contact being positioned on a portion of said outer surface of said first loop portion, said stationary contact being positioned at a point in-between said first and second support surfaces.

6. The circuit breaker as in claim 5, wherein said stationary contact is also positioned to align with said ferromagnetic material.

7. A circuit breaker as in claim 4, further including:

g) a second pair of tabs extending from said cassette into said area, said second pair of tabs maintaining said ferromagnetic material in a spatial relationship with respect to said inner surface of said second loop portion of said conductive path.

8. A circuit breaker as in claim 7, further including:

h) an air gap being positioned in between said inner surface of said second loop portion of said conductive path and said ferromagnetic material.

9. A circuit breaker as in claim 4, wherein said first pair of tabs are chamfered.

10. A circuit breaker as in claim 7, wherein said first and second pairs of tabs are chamfered.

11. The method of supporting a potion of a conductive path of a circuit breaker, comprising the steps of:

a) supporting a first portion of said conductive path at a first position and a second position, said first and second positions being positioned at either side of an area defined by said first portion and a second portion of said conductive path; and b) supporting a ferromagnetic material, said ferromagnetic material being positioned within said area, said ferromagnetic material being positioned to define an air gap in between said ferromagnetic material and said first portion of said conductive path; and c) extending a first pair of tabs into said area, said tabs being configured, dimensioned and positioned to maintain said ferromagnetic material within said area.

12. A support as in claim 1, further comprising:

g) an air gap being positioned in between said ferromagnetic material and said second portion of said conductive path.

13. A circuit breaker comprising:

a) at least one circuit interruption mechanism having at least one cassette, said cassette having inner and outer walls, said inner walls being in a facing spaced relationship and said cassette receiving and supporting a first conductive path, a portion of said first path being partially looped upon itself and having a first portion and a second portion, said first and second portions being in a facially spaced relationship so as to define a first area;

b) a pair of supporting members depending outwardly from said inner walls and being configured and dimensioned to be positioned in-between said first and second portions of said first conductive path, said pair of supporting members providing support to said first portion of said first conductive path;

c) a pair of tabs, one of said tabs extending outwardly from one of said inner walls and the other one of said tabs extends outwardly from the other inner wall;

d) a ferromagnetic material being positioned within said area and being supported by said pair of tabs whereby said ferromagnetic material is in a facially spaced relationship with respect to said first portion of said conductive path, and e) an air gap positioned in between said ferromagnetic material and said first portion of said conductive path.

14. A circuit breaker as in claim 13, wherein a portion of said ferromagnetic material is in contact with said second portion of said first conductive path.

15. A circuit breaker as in claim 13, wherein said first and second support portions are molded into said cassette.

16. A circuit breaker as in claim 15, wherein said cassette comprises a first body portion and a second body portion, said first and second body portions define said cassette and said first and second support portions depend outwardly from one of said body portions.

17. A circuit breaker comprising:

a) at least one cassette, said cassette having a pair of body portions having an inner and outer surface, said cassette receiving a conductive path, a portion of said conductive path being partially looped upon itself and having a first loop portion and a second loop portion, said first and second loop portions each have an inner surface and an outer surface, said inner surfaces of said first and second loop portions are in a facially spaced relationship so as to define an area;

b) a ferromagnetic material being supported by said cassette and positioned within said area, said ferromagnetic material being configured, dimensioned and positioned so that a surface of said ferromagnetic material is in contact with said inner surface of said second loop portion and in a facially spaced relationship with respect to said inner surface of said first loop portion;

c) a first support surface for supporting said inner surface of said first loop portion;

d) a second support surface for supporting said inner surface of said first loop portion of said conductive path, said first and second support surfaces being positioned at opposite sides of said area;

e) an air gap being positioned in between said ferromagnetic material and said first loop portion of said conductive path; and f) a first pair of tabs extending into said area, said tabs being configured, dimensioned and positioned to maintain said ferromagnetic material within said area.

18. A circuit breaker as in claim 13, wherein said cassette, said pair of supporting members and said pair of tabs are plastic.

19. A support as in claim 1, wherein said ferromagnetic material is a magnetic flux concentrator.

* * * * *